US010390119B2

(12) United States Patent
Lee

(10) Patent No.: US 10,390,119 B2
(45) Date of Patent: Aug. 20, 2019

(54) PORTABLE SPEAKER DEVICE AND METHOD FOR USING SAME

(71) Applicant: LEEDEYEON, INC., Seoul (KR)

(72) Inventor: Yeon Taek Lee, Seoul (KR)

(73) Assignee: LEEDEYEON, INC., Seoul (KR)

( * ) Notice: Subject to any disclaimer, the term of this patent is extended or adjusted under 35 U.S.C. 154(b) by 0 days.

(21) Appl. No.: 15/568,552

(22) PCT Filed: Jul. 29, 2016

(86) PCT No.: PCT/KR2016/008370
§ 371 (c)(1),
(2) Date: Oct. 23, 2017

(87) PCT Pub. No.: WO2017/057837
PCT Pub. Date: Apr. 6, 2017

(65) Prior Publication Data

US 2018/0115812 A1 Apr. 26, 2018

(30) Foreign Application Priority Data

Sep. 30, 2015 (KR) ..... 10-2015-0138208

(51) Int. Cl.
*H04R 1/02* (2006.01)
*H04R 3/00* (2006.01)
(Continued)

(52) U.S. Cl.
CPC ..... *H04R 1/025* (2013.01); *H04R 1/026* (2013.01); *H04R 1/2811* (2013.01);
(Continued)

(58) Field of Classification Search
CPC ..... H04R 1/025; H04R 1/023; H04R 1/026; H04R 1/2811; H04R 1/2819; H04R 1/323;
(Continued)

(56) References Cited

U.S. PATENT DOCUMENTS 5,590,771 A * 1/1997 Cota ..... A45C 9/00 190/102
2015/0222985 A1* 8/2015 Lin ..... H04R 1/44 381/334

(Continued)

FOREIGN PATENT DOCUMENTS

JP 2000-253476 A 9/2000
JP 2005-151237 A 6/2005
KR 10-2009-0002539 A 1/2009

OTHER PUBLICATIONS

Yeon Taek Lee, Bluetooth speaker with optimal sound when placed on top of an empty bottle?! Bottle Cap Bluetooth speaker Cork, Aug. 26, 2015, <URL: https://ww.wadiz.kr/web/campaign/detail/1773>.

*Primary Examiner* — Tuan D Nguyen
(74) *Attorney, Agent, or Firm* — Korus Patent, LLC; Seong Il Jeong

(57) ABSTRACT

The present invention relates to a portable speaker device usable with a container and a method for using the same. The portable speaker device has a structure to be mounted on containers of various kinds, materials, shapes and sizes to be discarded. That is, the portable speaker device includes a first mounting member mounted in an opening of a container. The portable speaker device further includes a second mounting member coupled to the first mounting member and provided to be mountable on containers of various sizes. The portable speaker device receives sound source data reproduced from a mobile device through wireless communication, and outputs the reproduced sound of a speaker through the container. According to the present invention, the portable speaker device is mounted in the opening of the container through the first mounting member or the second mounting member so as to transmit the reproduced sound to the container to be output, such that the container to be
(Continued)

discarded is recycled, and a clear and clean sound quality can be provided by enhancing the sound quality, the bass effect, and the sound volume of the speaker through the container.

10 Claims, 12 Drawing Sheets

(51) Int. Cl.
*H04R 1/28* (2006.01)
*H04R 1/32* (2006.01)

(52) U.S. Cl.
CPC ..... *H04R 1/2819* (2013.01); *H04R 1/323* (2013.01); *H04R 3/00* (2013.01); *H04R 1/023* (2013.01); *H04R 2201/025* (2013.01); *H04R 2420/07* (2013.01)

(58) Field of Classification Search
CPC . H04R 3/00; H04R 2201/025; H04R 2420/07
See application file for complete search history.

(56) References Cited

U.S. PATENT DOCUMENTS

2015/0271582 A1* 9/2015 Cheng ..... H04R 1/028
381/334
2015/0300581 A1* 10/2015 Huang ..... F21L 4/00
362/86

* cited by examiner

PORTABLE SPEAKER DEVICE AND METHOD FOR USING SAME

TECHNICAL FIELD

The present invention relates to a portable speaker device, and more particularly, to a portable speaker device usable with a container, which is mounted on the container to improve the sound quality of a speaker, the bass effect, and the volume of sound through the container, so as to recycle various types of containers to be discarded, manufacture or use dedicated containers to be used with the portable speaker device, and provide a clearer and cleaner sound quality.

BACKGROUND ART

Due to the recent development of digital technology and mobile communication technology, a user can carry mobile devices, for example, a smartphone, a tablet, a PC, a notebook, and the like, and use the mobile devices anywhere. These mobile devices basically have the function that can store music files and reproduce the stored music files.

Recently, various speaker devices and headset devices, which receive and output music files reproduced in mobile devices by using, for example, Bluetooth wireless communication, have been developed, manufactured, and distributed. In particular, the speaker device is called a Bluetooth speaker device and has an advantage that most users can carry the speaker device and enjoy music at a desired place according to life patterns of the users who enjoy many outdoor activities.

Bluetooth is a protocol for standard short-range wireless communication, and the Bluetooth device is commonly recognized and connected between two devices through a series of operations, such as pairing with the mobile device, mutually transmits various signals via a Bluetooth communication network.

However, most Bluetooth speaker devices have better sound quality than speaker devices of the mobile devices, but are much lower than high-power speaker devices present in a home or other places. As the users desire to enjoy music files stored in the mobile devices with better sound quality, the users try to find speaker devices with better sound quality. Therefore, there is a need for a new type of Bluetooth speaker device that can satisfy the user's demand.

DETAILED DESCRIPTION OF THE INVENTION

Technical Problem

One or more embodiments provide a portable speaker device for improving the sound quality, the bass effect, and the volume of sound, and a method for using the same.

One or more embodiments provide a portable speaker device, which is usable with various containers, and a method for using the same.

One or more embodiments provide a portable speaker device, which is capable of protecting the environment by recycling a container to be discarded and enjoying music in a new way, and a method for using the same.

Technical Solution

In order to achieve the above objects, a portable speaker device according to the present invention includes at least one speaker, is mounted on a container, receives reproduced sound source data from a mobile device through wireless communication, and output a reproduced sound. Since the reproduced sound of the speaker is transmitted to the container and output therethrough, the portable speaker device according to the present invention is capable of improving the sound quality, the bass effect, and the volume of the reproduced sound.

The portable speaker device according to the present invention is provided to be usable with the container having the opening in a portion.

According to one aspect of the present invention, a portable speaker device, which is usable with a container having an opening in a portion thereof, includes: at least one speaker; a signal processor configured to receive sound source data reproduced from an external electronic device by using wired or wireless communication and perform signal processing thereon to output the reproduced sound of the sound source data through the speaker; a housing provided in a pillar shape in which upper portion and lower portion thereof are opened, wherein the speaker is installed in at least one of the upper portion and the lower portion of the housing, and the signal processor is installed inside the housing; and a first mounting member coupled to a lower end of the housing and mounted in the opening so that the reproduced sound of the sound source data output from the speaker is transmitted to the container.

According to one embodiment, the portable speaker device further includes a second mounting member coupled to a lower end of the first mounting member, so that the container having the opening with a different diameter is inserted and mounted into a lower portion of the second mounting member.

According to another embodiment, the speaker includes: a first speaker disposed in an upper portion of the housing to output a treble of the reproduced sound in an upward direction of the housing; and a second speaker disposed in a lower portion of the housing to output a bass of the reproduced sound inn a downward direction of the housing.

According to another embodiment, the signal processor includes: a wireless communication unit configured to enable wireless communication with the external electronic device; a sound source processing unit configured to output the reproduced sound of the sound source data received from the wireless communication unit to the first and second speakers; and a controller configured to control the wireless communication unit and the sound source processing unit.

According to another embodiment, the housing includes: a first rubber damper coupled to an upper portion of the first speaker to cover a front surface of the first speaker; a protection cover disposed above the first rubber damper and coupled to an inner upper end of the housing to protect the first speaker; a fixing member inserted into the housing and fixedly coupled to the housing to fix a printed circuit board, on which a power switch, a battery, and a charging socket connector are mounted, and fix the first and second speakers and the signal processor; a second rubber damper coupled to a lower portion of the second speaker to cover a front surface of the second speaker; and a coupling groove which is formed in an inner lower end and to which an upper portion of the first mounting member is fixedly coupled.

According to another embodiment, the first mounting member includes: a container coupling part coupled to the opening in an outer or inner space of a lower end; a housing coupling part coupled to the coupling groove of the housing; and a flat plate part provided inside the housing coupling part and stacked in a lower portion of the second rubber damper to cover a lower surface of the housing.

According to another embodiment, the second mounting member includes: a container coupling part insertion port which has a cylindrical shape of a double structure where an upper portion is separated and a lower portion is mutually coupled, and into which the container coupling part of the first mounting member is inserted; and a container insertion port which is provided inside the container coupling part insertion port and into which the opening of the container is inserted.

According to another embodiment, the portable speaker device further includes a cradle installed indoors and held to output the reproduced sound of the sound source data, or held to charge a battery for supplying power to the portable speaker device.

According to another aspect of the present invention, a method for using a portable speaker device is provided.

A method for using a portable speaker device according to the present invention includes: when a power switch of the portable speaker device is pressed, supplying power through a battery of the portable speaker device; recognizing the portable speaker device through wireless communication by an external mobile device and connecting the mobile device to the portable speaker device; mounting a first mounting member of the portable speaker device on a container having an opening in a portion; and reproducing sound source data from the mobile device, receiving the reproduced sound source data from the mobile device through wireless communication, and transmitting the reproduced sound of the sound source data to the container.

According to one embodiment, the method further includes, when a diameter of the opening of the container is smaller than a diameter mounted on the first mounting member, coupling a second mounting member to the first mounting member and mounting the container on the second mounting member.

Advantageous Effects

As described above, the portable speaker device according to the present invention includes at least one speaker, is mounted on containers having various types, materials, shapes, and sizes, receives sound source data from an external electronic device by using wireless communication or a cable, and outputs the reproduced sound of the sound source data, so that the reproduced sound of the sound source data is transmitted to the container and output therethrough. Therefore, the sound quality, the bass effect, and the volume of the reproduced sound may be improved to provide the reproduced sound of the portable speaker device cleanly and clearly.

In addition, the portable speaker device includes at least one speaker and is mounted on the containers having various types, materials, shapes, and sizes to output the reproduced sound of the sound source data, so that the user can enjoy music in a new way and feeling.

Furthermore, since the portable speaker device according to the present invention provides the cradle-type mounting member, it is possible to use containers having various types, materials, shapes, and sizes in enjoying music, thereby recycling containers and protecting the environment.

Moreover, since the portable speaker device according to the present invention provides the cradle capable of holding the portable speaker device and charging the battery, the portable speaker device may be usually held and dept indoors and may be used to enjoy music and charge the battery.

BEST MODE

Figure 1:
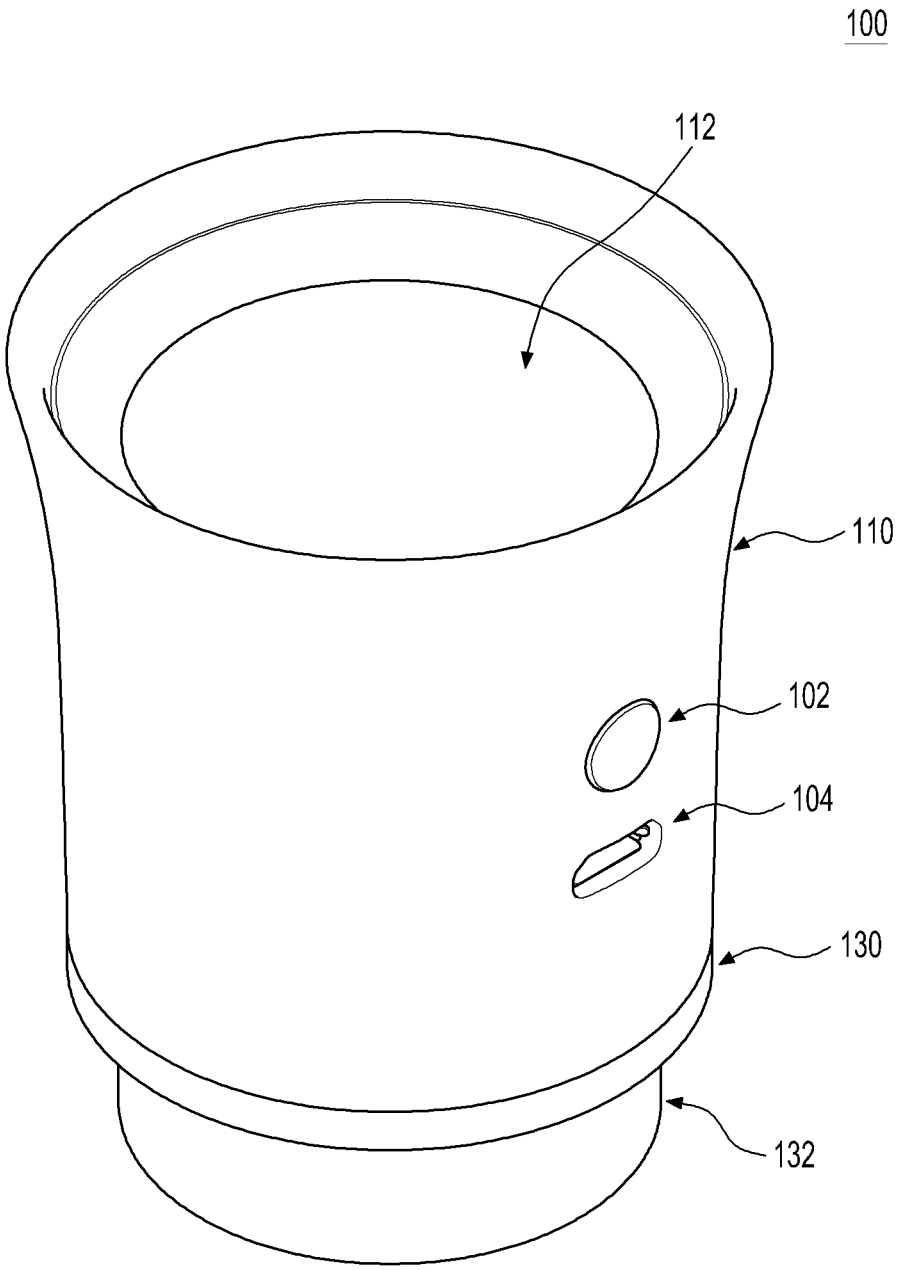
FIGS. 1 and 2 are perspective views showing a configuration of a portable speaker device according to the present invention.

Embodiments of the present invention may be modified in various forms, and the scope of the invention should not be construed as limited to the following embodiments. These embodiments are provided so that this disclosure will be thorough and complete, and will fully convey the scope f the invention to those skilled in the art. Therefore, shapes of constituent elements in the drawings are exaggerated for clearer explanation.

Hereinafter, embodiments of the present invention will be described in detail with reference to FIGS. 1 to 12.

Figure 2:
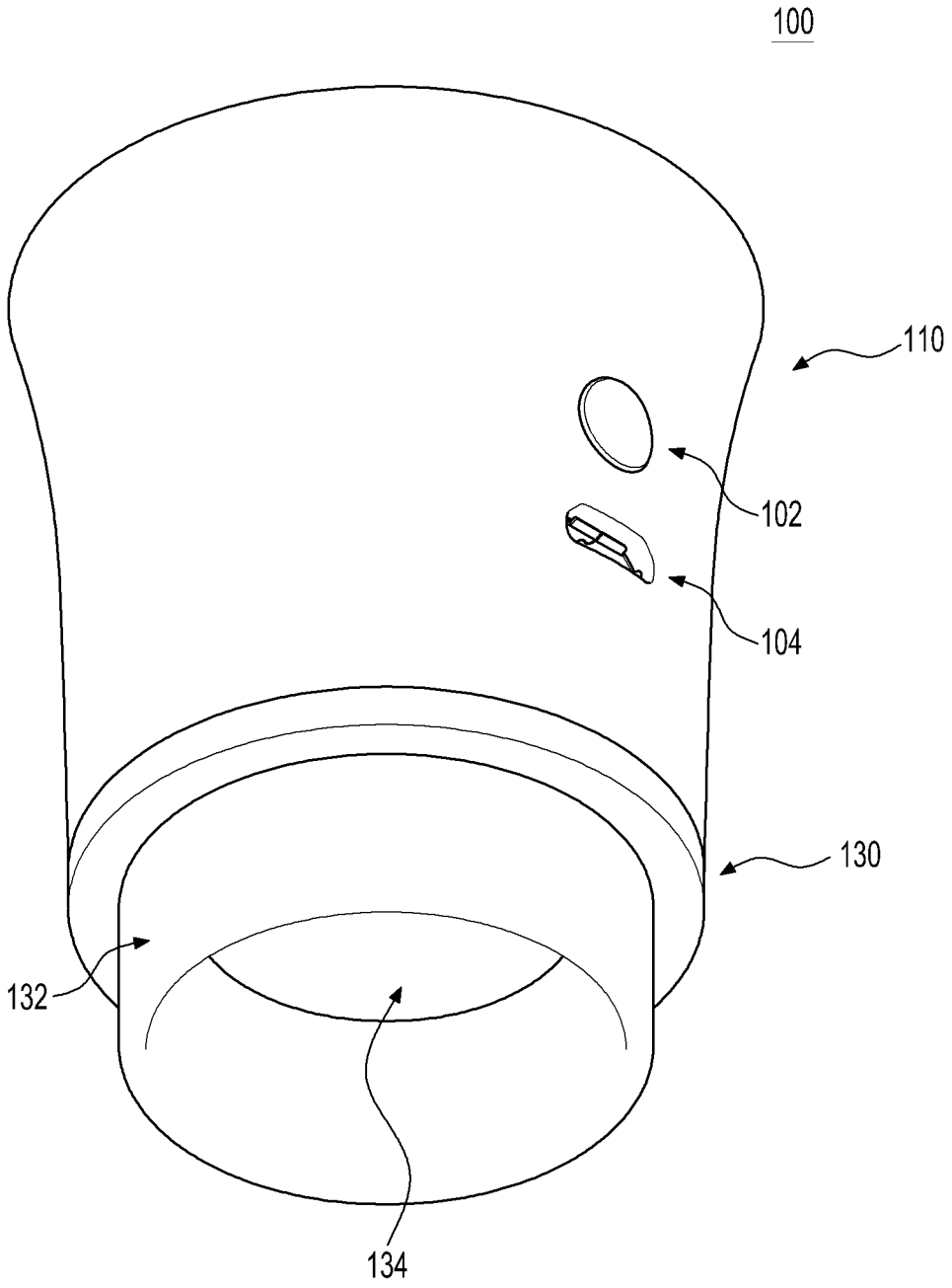

FIGS. 1 and 2 are perspective views showing a configuration of a portable speaker device according to the present invention.

Referring to FIGS. 1 and 2, the portable speaker device 100 according to the present invention includes at least one speaker (106 and 108 of FIG. 5), is mounted on containers (200 of FIG. 8 and 210 to 230 of FIG. 9) having various types, materials, shapes, and sizes, and receive sound source data from an external electronic device, for example, a mobile device (20 of FIG. 7), by using wireless communication or a cable and reproduces the sound source data. At this time, since the portable speaker device 100 outputs sound so that the reproduced sound of the sound source data is transmitted to the container, the portable speaker device 100 improves the sound quality, the bass effect, and the volume of the reproduced sound.

In the present invention, each of the containers 200 to 230 has an opening (202 of FIG. 8) in a portion thereof and has various types, materials, shapes, and sizes. In addition, the opening 202 of each of the containers 200 to 230 may have various sizes. Such containers 200 to 230 can be easily discarded after used once. Examples of such containers 200 to 230 may include coffee bottles, juice bottles, beverage bottles, wine bottles, milk bottles, and the like. In many cases, such containers 200 to 230 have a pretty design and are still too good to throw away. Therefore, the portable speaker device 100 according to the present invention is provided to be usable with these containers 200 to 230. In an embodiment of the present invention, a case where the containers 200 to 230 are a glass bottle so as to provide the reproduced sound of the portable speaker device 100 clearly and cleanly will be described below. In the present invention, the containers 200 to 230 may be usually used and have various closed shapes with an opening in a portion thereof. For example, tumblers, interior accessories, porcelains, vases, and the like may be used. A separate container separately prepared for use with the portable speaker device 100 may be used.

Therefore, one side of the portable speaker device 100 according to the present invention is mounted on the containers 200 to 230 having various types, materials, shapes, and sizes, so that the reproduced sound of the sound source data is transmitted to the containers 200 to 230. Thus, the containers 200 to 230 may perform a function similar to a vacuum tube to improve the sound quality, the bass effect, and the volume of the reproduced sound. This provides a clear and clean sound, and the user can enjoy the sound source with a different feeling. In addition, in the present invention, the containers 200 to 230 to be discarded are used with the portable speaker device 100, thereby recycling the containers 200 to 230 and protecting the environment.

To this end, the portable speaker device 100 according to the present invention includes a housing 110, and a first mounting member 130 having an upper portion coupled to the housing 110 and a lower portion mounted on the container 200.

In this embodiment, the housing 110 is made of, for example, a non-toxic silicone material that is an eco-friendly material, and has a cylindrical shape in which at least one speaker, a signal processor for receiving and reproducing the sound source data, a battery for supplying power, and the like are fixedly installed. In addition, the housing 110 may have various shapes so that the components of the portable speaker device 100 can be installed in the internal space thereof, and can be mounted on the container.

The upper portion and the lower portion of the housing 110 are opened. The speaker is disposed in the opened upper portion and/or the opened lower portion of the housing 110. The housing 110 further includes a protection cover 112 for protecting the speaker installed in the upper portion thereof.

In addition, the housing 110 includes a power switch 102 and a socket connector 104 on one side thereof. The power switch 102 operates the portable speaker device 100. The socket connector 104 is connected to a power supply source (not shown) to charge an internal battery, or is connected to a plug connector (10 of FIG. 5) to receive sound source data through a cable.

The first mounting member 130 is made of a material identical or similar to that of the housing 110, for example, a silicone material, and is coupled to the lower portion of the housing 110. In addition, the first mounting member 130 includes a container coupling part 132, which is coupled to the containers 200 to 230, in a lower end thereof. An opening 202 of each of the containers 200 to 230 is inserted or fitted into the inside 134 or outside of the container coupling part 132 according to a diameter of the opening 202. Therefore, the portable speaker device 100 is mounted on the containers 200 to 230 through the first mounting member 130. In this case, the containers 200 to 230 have the opening 202 with a diameter appropriate to an inner diameter or an outer diameter of the first mounting member 130.

MODE OF THE INVENTION

Figure 3:
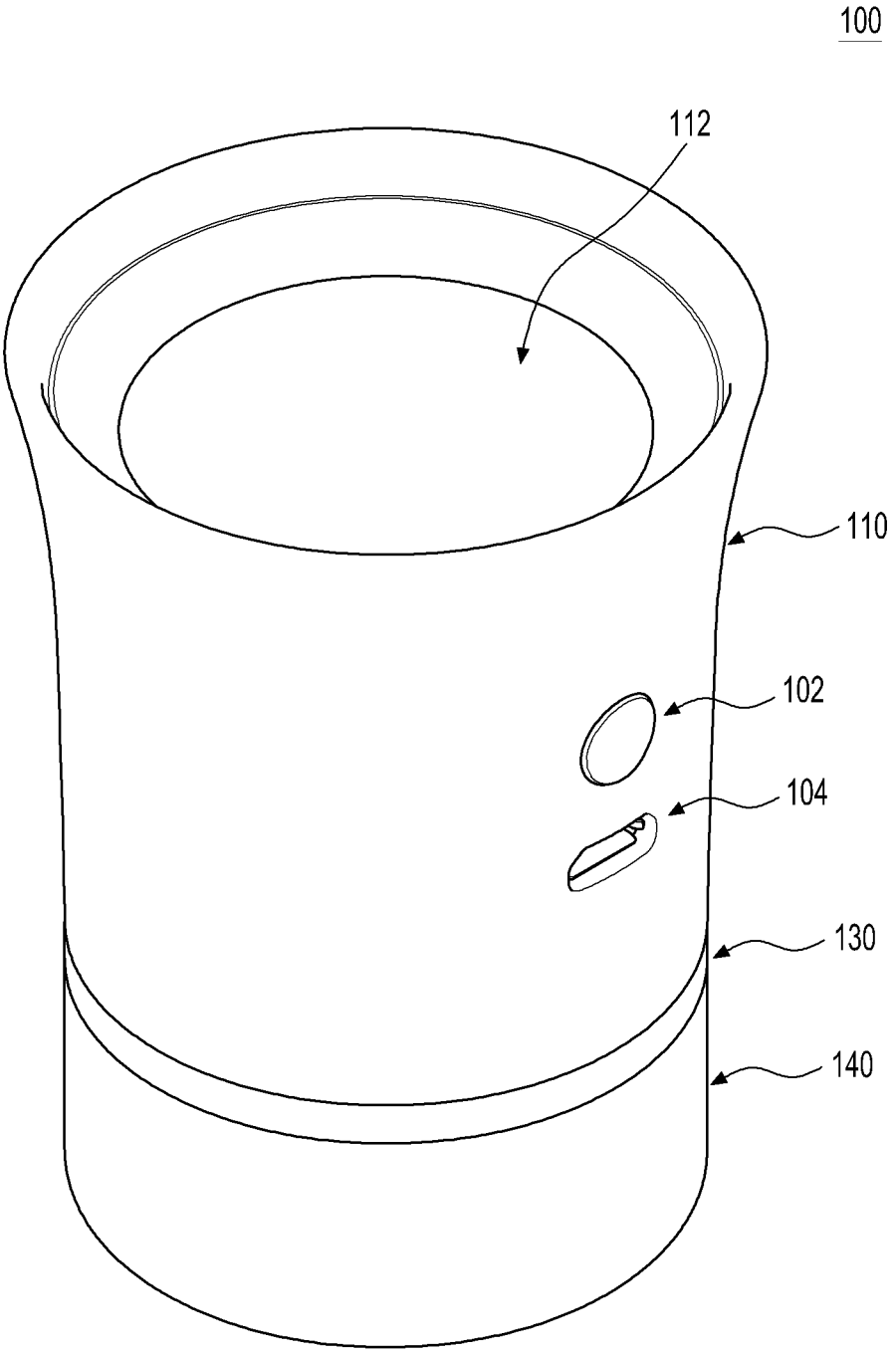
FIG. 3 is a perspective view showing a state in which a connection member is mounted on the portable speaker device shown in FIG. 1.
Figure 4:
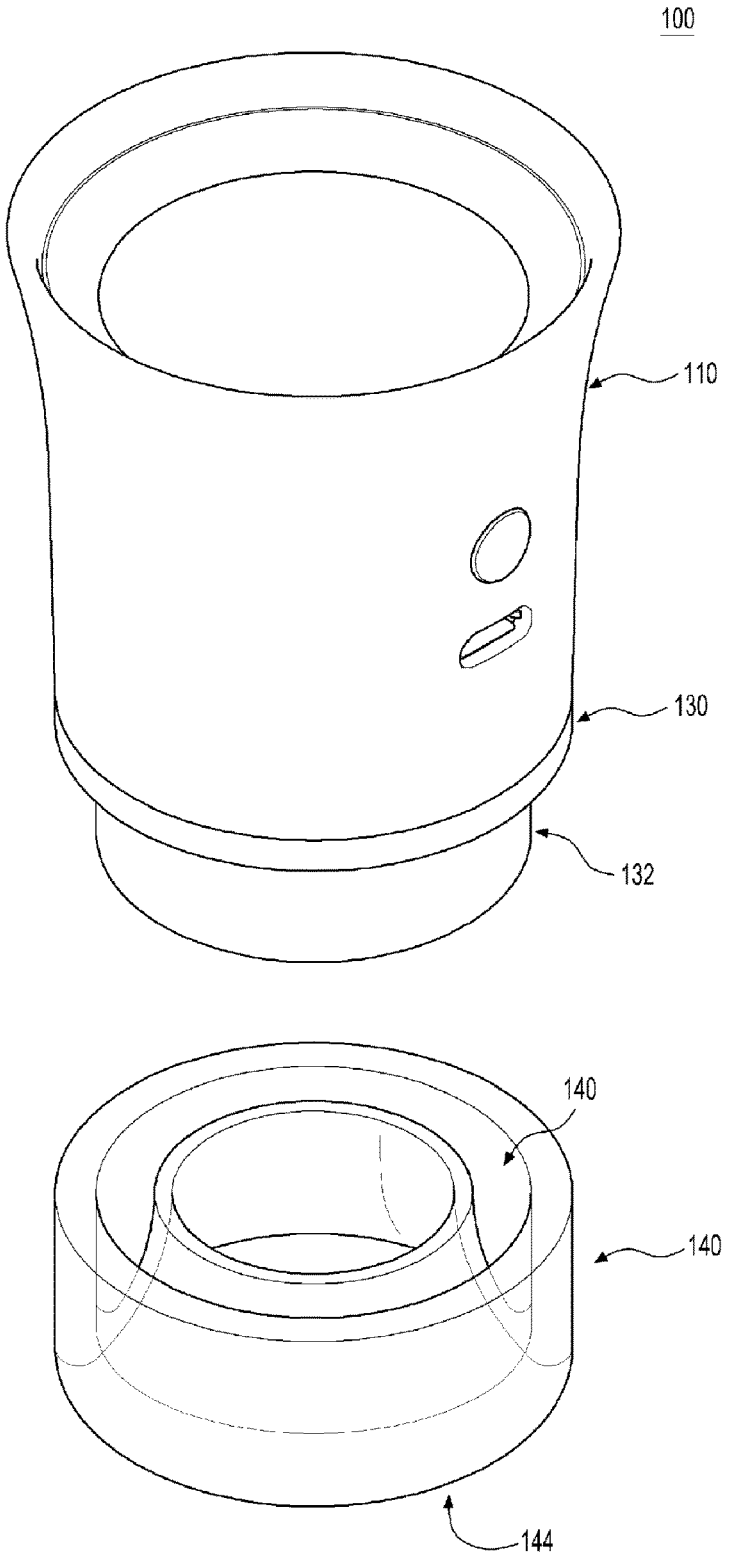
FIG. 4 is a perspective view showing a state in which the connection member is separated from the portable speaker device shown in FIG. 3.

FIG. 3 is a perspective view showing a state in which a second mounting member is mounted on the portable speaker device shown in FIG. 1, and FIG. 4 is a perspective view showing a state in which the second mounting member is separated from the portable speaker device shown in FIG. 3.

Referring to FIGS. 3 and 4, the portable speaker device 100 according to the present invention further includes a second mounting member 140 that is inserted into and coupled to the lower portion of the first mounting member 130, so as to be mounted on each of the containers 200 to 230 with the openings 202 having various sizes.

In this embodiment, the second mounting member 140 includes, for example, a cradle and has a cylindrical shape of a double structure in which an upper portion thereof is spaced apart and a lower portion thereof is coupled. The second mounting member 140 is made of a material identical to or similar to that of the first mounting member 130, for example, a silicone material.

The second mounting member 140 has an inner wall and an outer wall. The inner wall and the outer wall of the second mounting member 140 are spaced apart from each other by a predetermined interval, and a lower portion of the inner wall and a lower portion of the outer wall are coupled to each other. To this end, the inner wall in this embodiment has an elastic force and is formed to be inclined in a direction from the upper portion to the lower portion. In another example, the inner wall forms a spiral protrusion so as to be inserted into and engaged with a spiral groove formed outside the opening of the container. In this manner, the inner wall is coupled to the opening of the container.

Therefore, the container coupling part 132 of the first mounting member 130 is inserted into a space between the inner wall and the outer wall of the second mounting member 140, and the openings 202 of the containers 200 to 230 are inserted into the inside of the inner wall. That is, the second mounting member 140 includes a container coupling part insertion port 142 into which the container coupling part 132 of the first mounting member 130 is inserted, and a container insertion port 144 which is provided inside the container coupling part insertion port 142 and in which the openings 202 of the containers 200 to 230 are inserted.

Therefore, the inner wall may be expanded toward the outer wall according to the diameters of the openings 202 of the containers 200 to 230 so that containers having various sizes can be mounted in the container insertion port 144.

Next, the configuration of the portable speaker device according to the present invention will be described in detail.

Figure 5:
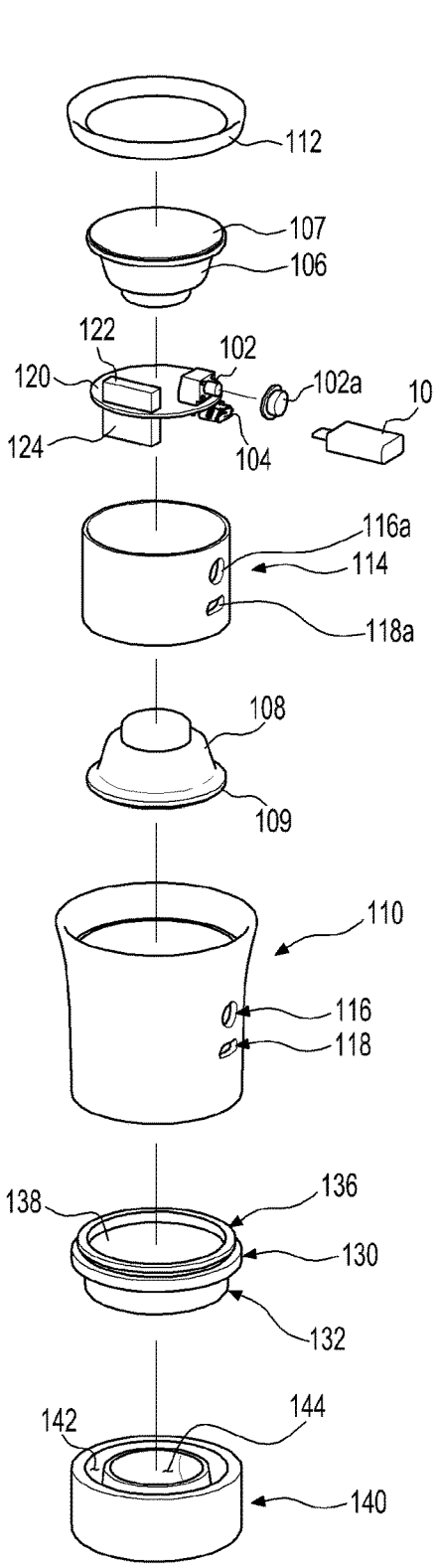
FIG. 5 is an exploded perspective view of the portable speaker device shown in FIG. 3.
Figure 6:
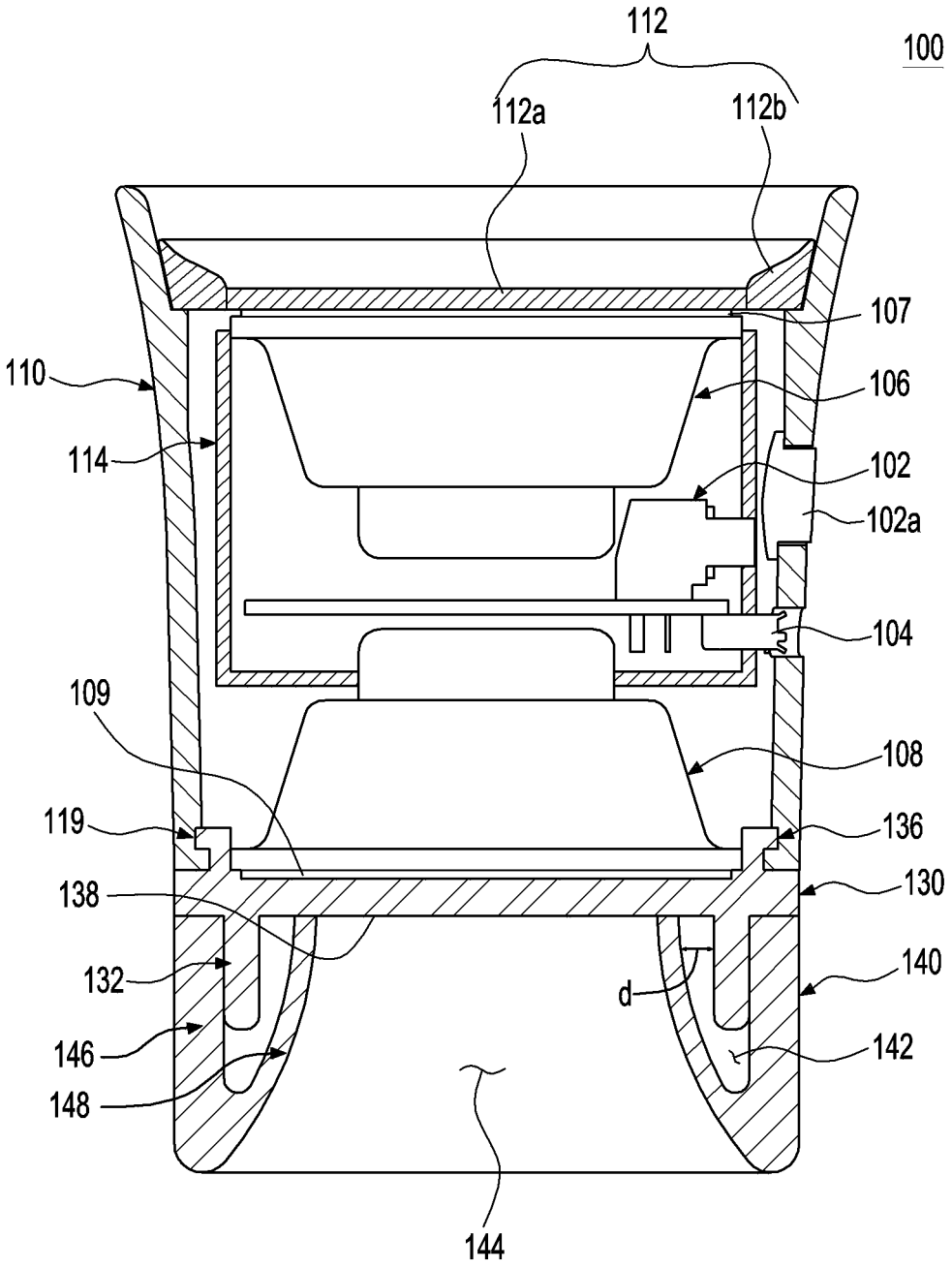
FIG. 6 is a cross-sectional view of the portable speaker device shown in FIG. 3.
Figure 7:
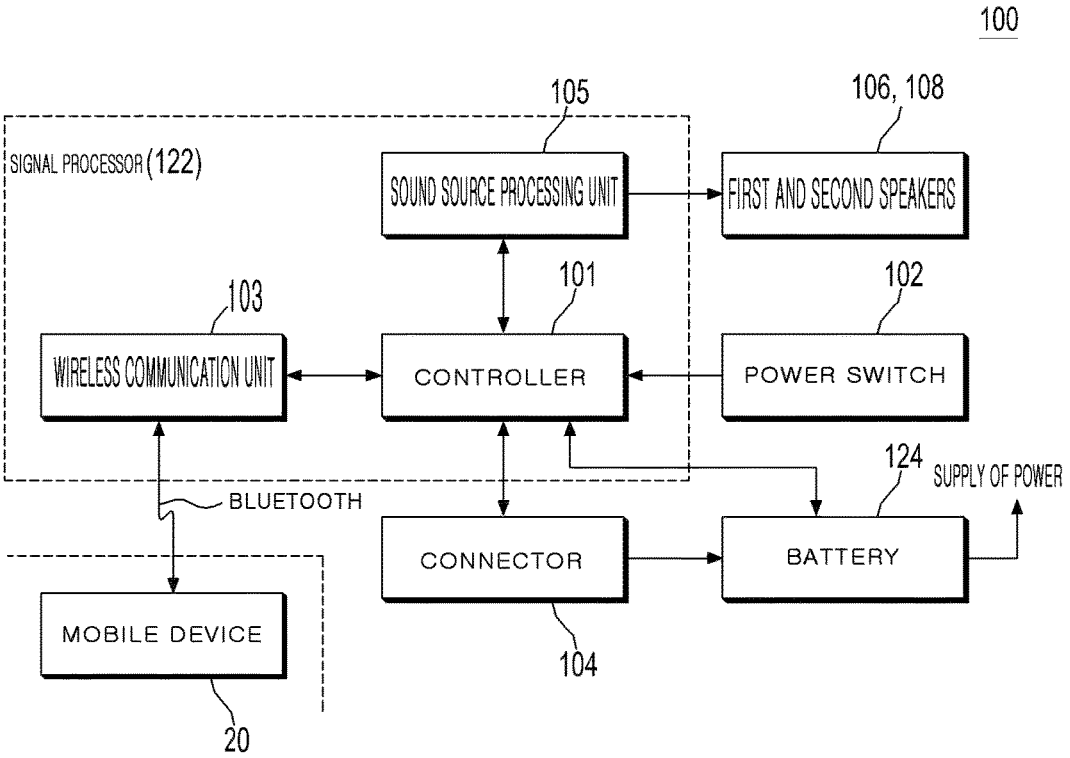
FIG. 7 is a block diagram showing the configuration of the portable speaker device shown in FIG. 1 or 3.

FIG. 5 is an exploded perspective view of the portable speaker device shown in FIG. 3, FIG. 6 is a cross-sectional view of the portable speaker device shown in FIG. 3, and FIG. 7 is a block diagram showing the configuration of the portable speaker device shown in FIG. 1 or 3.

Referring to FIGS. 5 to 7, the portable speaker device 100 according to the present embodiment includes the housing 110, the power switch 102, the socket connector 104, the first and second speakers 106 and 108, the protection cover 112, a fixing member 114, a printed circuit board 120, the signal processor 122, the battery 124, and the first and second mounting members 130 and 140. The portable speaker device 100 further includes first and second rubber dampers 107 and 109.

The housing 110 has a cylindrical shape in which upper portion and the lower portion are opened and the central portion is concavely rounded inward from the upper portion to the lower portion. The fixing member 114 is installed in the inner space of the housing 110. The protection cover 112 is installed inside the opened upper portion of the housing 110. In addition, a first power switch mounting hole 116 and a first socket connector mounting hole 118 are provided on one side of the housing 110, so that the power switch 102 and the socket connector 104 are respectively installed therein.

The first speaker 106 is fixedly installed at the upper end of the fixing member 114 so as to be positioned in the upper portion of the housing 110, and the second speaker 108 is fixedly installed at the lower end of the fixing member 114 so as to be positioned in the lower portion of the housing 110. The first and second rubber dampers 107 and 109 are respectively installed on the front surfaces of the first and second speakers 106 and 108. In this embodiment, the first speaker 106 outputs a treble of the sound source data, and the second speaker 108 outputs a bass of the sound source data.

The first and second rubber dampers 107 and 109 seal the first and second speakers 106 and 108 by covering the upper portions of the first and second speakers 106 and 108, so that the reproduced sounds output from the first and second speakers 106 and 108 are transmitted to the outside of the housing 110.

The protection cover 112 is coupled to the inner upper end of the housing 110 at the upper end of the first rubber damper 107 so as to protect the first speaker 106 from external impact. As shown in FIG. 6, the protection cover 112 in this embodiment includes a coupling ring 112*b* coupled to the inner upper end of the housing 110, and a cover 112*a* formed as a circular flat plate in the inside of the coupling ring 112*b* and stacked adjacent to the first rubber damper 107 to cover the first rubber damper 107.

The fixing member 114 has a cylindrical shape in which upper and lower portions thereof are opened corresponding to the inner wall of the housing 110. The first speaker 106 is fixedly installed in the upper portion of the fixing member 114, and the second speaker 108 is fixedly installed in the lower portion of the fixing member 114. In addition, the printed circuit board 120 is fixedly installed inside the fixing member 114. In addition, a second power switch mounting hole 116*a* and a second socket connector mounting hole 118*a* are formed on one side of the fixing member 114 at positions corresponding to the first power switch mounting hole 116 and the first socket connector mounting hole 118, respectively. The signal processor 122 and the power switch 102 are mounted on the upper surface of the printed circuit board 120, and the battery 124 and the socket connector 104 are installed on the lower surface of the printed circuit board 120. In this case, the signal processor 122, the power switch 102, the battery 124, and the socket connector 104 are electrically connected to one another by circuit patterns of the printed circuit board 120.

The power switch 102 is installed on one side of the upper surface of the printed circuit board 120 and is connected to a power switch cap 102*a* on the outer surface of the housing 110 through the fixing member 114 and the first and second power switch mounting holes 116 and 116*a* formed in the housing 110. Therefore, the user operates the portable speaker device 100 by pressing the power switch cap 102*a*.

The socket connector 104 is installed on one side of the lower surface of the printed circuit board 120 in the lower portion of the power switch 102 and is provided such that a plug connector 10 of the mobile device 20 or a charging connector (340 of FIG. 10) is inserted thereinto from the outside of the housing 110 through the fixing member 114 and the first and second power switch mounting holes 116 and 116*a* formed in the housing 110.

The signal processor 122 is provided with, for example, at least one semiconductor integrated circuit (IC). As shown in FIG. 7, the signal processor 122 includes a wireless communication unit 103 configured to enable wireless communication with the mobile device 20, a sound source processing unit 105 configured to output the reproduced sound of the sound source data received from the wireless communication unit 103 to the first and second speakers 106 and 108, and a controller 101 configured to control an overall operation of the signal processor 122. It has been described that the signal processor 122 is provided with the single semiconductor IC, but the wireless communication unit 103, the sound source processing unit 105, and the controller 101 may be provided with separate semiconductor ICs or circuit modules.

The controller 101 controls the wireless communication unit 103 to enable wireless communication between the portable speaker device 100 and the mobile device 20, and controls the sound source processing unit 105 to output the sound source data received from the wireless communication unit 103 to the first and second speakers 106 and 108. When the power switch 102 is pressed, the controller 101 controls the battery 124 to supply power to the portable speaker device 100. In addition, when the power is supplied from an external power supply source to the socket connector 104, the controller 101 controls the charging of the battery 124, and when the data is transmitted from an external through a cable to the socket connector 104, the controller 101 receives and processes the data. In this case, the data transmitted through the socket connector 104 may include sound source data or firmware for upgrading the controller 101.

The battery 124 is provided with a rechargeable battery. The battery 124 supplies power to the portable speaker device 100 under control of the controller 101, and is charged by using power supplied from the external power supply source through the socket connector 104.

The first mounting member 130 includes a container coupling part 132, a housing coupling part 136, and a flat plate part 138. The container coupling part 132 has a cylindrical shape and forms an internal space 134 into which the openings 202 of the containers 200 to 230 can be inserted. The housing coupling part 136 has a ring shape protruding outward at an upper end thereof and is coupled to an inner lower end of the housing 110. The housing coupling part 136 is fixedly coupled to a coupling groove 119 formed in the inner lower end of the housing 110. The flat plate part 138 is provided with a circular flat plate on the inner side of the housing coupling part 136 and is stacked on the lower portion of the second rubber damper 109 to cover the lower surface of the housing 110. Therefore, the opened upper portion and the opened lower portions of the housing 110 are sealed by the protection cover 112 and the first mounting member 130.

When the container is mounted on the first mounting member 130, the openings 202 of the containers 200 to 230 are tightly inserted into the flat plate part 138 to seal the inner spaces of the containers 200 to 230, thereby performing the function similar to the vacuum tube (for example, rectification, amplification, or the like of the reproduced sound).

The second mounting member 140 is coupled to the lower end of the container coupling part 132 of the first mounting member 130. The second mounting member 140 includes an inner wall 148 and an outer wall 146. Upper portions of the inner wall 148 and the outer wall 146 are spaced apart by a predetermined interval to form the container coupling part insertion port 142 into which the container coupling part 132 of the first mounting member 130 is inserted. In addition, the second mounting member 140 forms the container insertion port 144, into which the openings 202 of the containers 200 to 230 are inserted, in an inner space of the inner wall 148.

Therefore, when the openings 202 of the containers 200 to 230 are inserted into the container insertion port 144 of the second mounting member 140, the inner wall 148 having an elastic force expands in a predetermined interval (d) range according to the diameters of the openings 202 of the containers 200 to 230. Thus, the second mounting member 140 may allow the containers 200 to 230 having various diameters to be inserted and mounted thereinto. At this time, the openings 202 of the containers 200 to 230 are tightly inserted into the flat plate part 138 of the first mounting member 130 to seal the inner spaces of the containers 200 to 230, thereby performing the function similar to the vacuum tube (for example, rectification, amplification, or the like of the reproduced sound).

Figure 8:
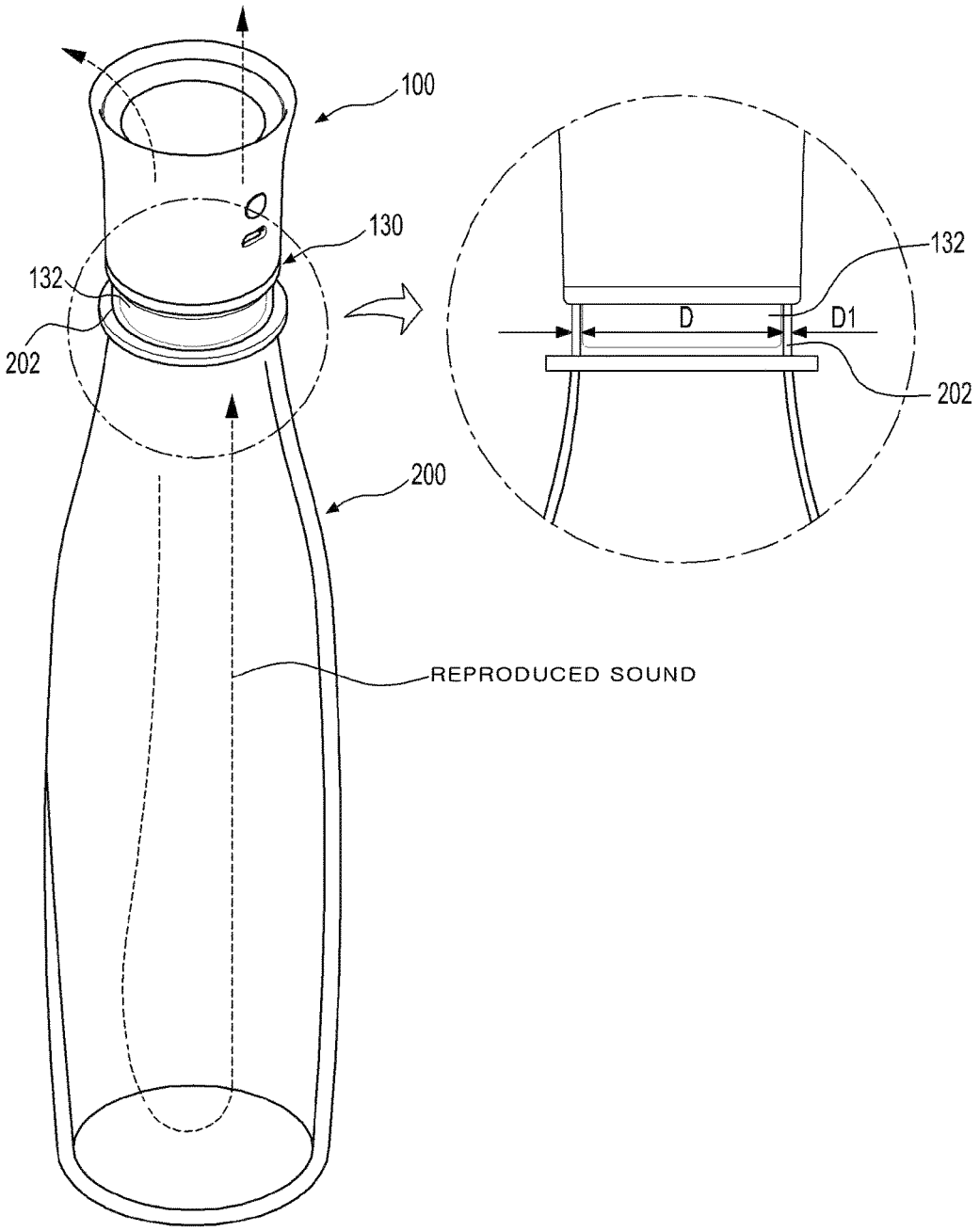
FIG. 8 is a view showing a state in which a portable speaker device according to an embodiment of the present invention is mounted on a container.
Figure 9:
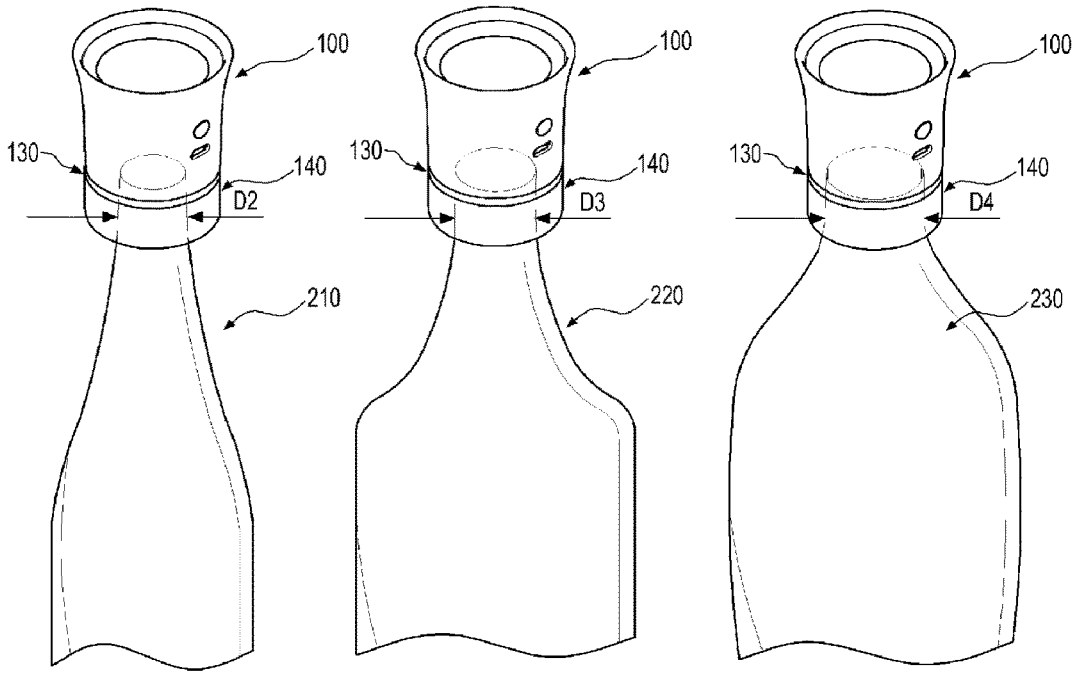
FIG. 9 is a view showing a state in which a portable speaker device according to another embodiment of the present invention is mounted on containers having various sizes.

FIG. 8 is a view showing a state in which a portable speaker device according to an embodiment of the present invention is mounted on the container, and FIG. 9 is a view showing a state in which a portable speaker device according to another embodiment of the present invention is mounted on containers having various sizes.

Referring to FIG. 8, in the portable speaker device 100 of this embodiment, the container 200 is inserted and mounted into the container coupling part 132 of the first mounting member 130. At this time, since a diameter D of the container coupling part 132 is smaller than a diameter D1 of the opening 202 of the container 200, the opening 202 of the container 200 is inserted into the outer surface of the container coupling part 132. When the diameter of the opening 202 of the container 200 is identical to the diameter of the container coupling part 132, the opening 202 of the container 200 may be inserted into the inner space (134 of FIG. 2) of the container coupling part 132.

Therefore, when the sound source data is reproduced from the portable speaker device 100, the treble of the reproduced sound is output to the outside, and the bass is output to the outside through the inner space of the container 200. Thus, the container 200 processes the function similar to the vacuum tube.

As another example, referring to FIG. 9, in the portable speaker device 100 of this embodiment, the second mounting member 140 is coupled to the first mounting member 130, and the containers 210 to 230 having various diameters D2, D3, and D4 are inserted and mounted into the second mounting member 140. That is, the diameter D2 of the opening of the first container 210 shown in (a) of FIG. 9 is smaller than the diameter D3 of the opening of the second container 220 shown in (b) of FIG. 9, and the diameter D4 of the opening of the third container 230 shown in (c) of FIG. 9 is larger than the diameter D3 of the opening of the second container 220. In addition, the diameters of the openings of the first to third containers 210 to 230 are smaller than the diameter D1 of the opening of the container 200 shown in FIG. 8.

Therefore, in the portable speaker device 100, when the containers 210 to 230 cannot be mounted on the first mounting member 130, the second mounting member 140 is mounted on the first mounting member 130 so that the containers 210 to 230 having various diameters D2, D3, and D4 are mounted.

Figure 10:
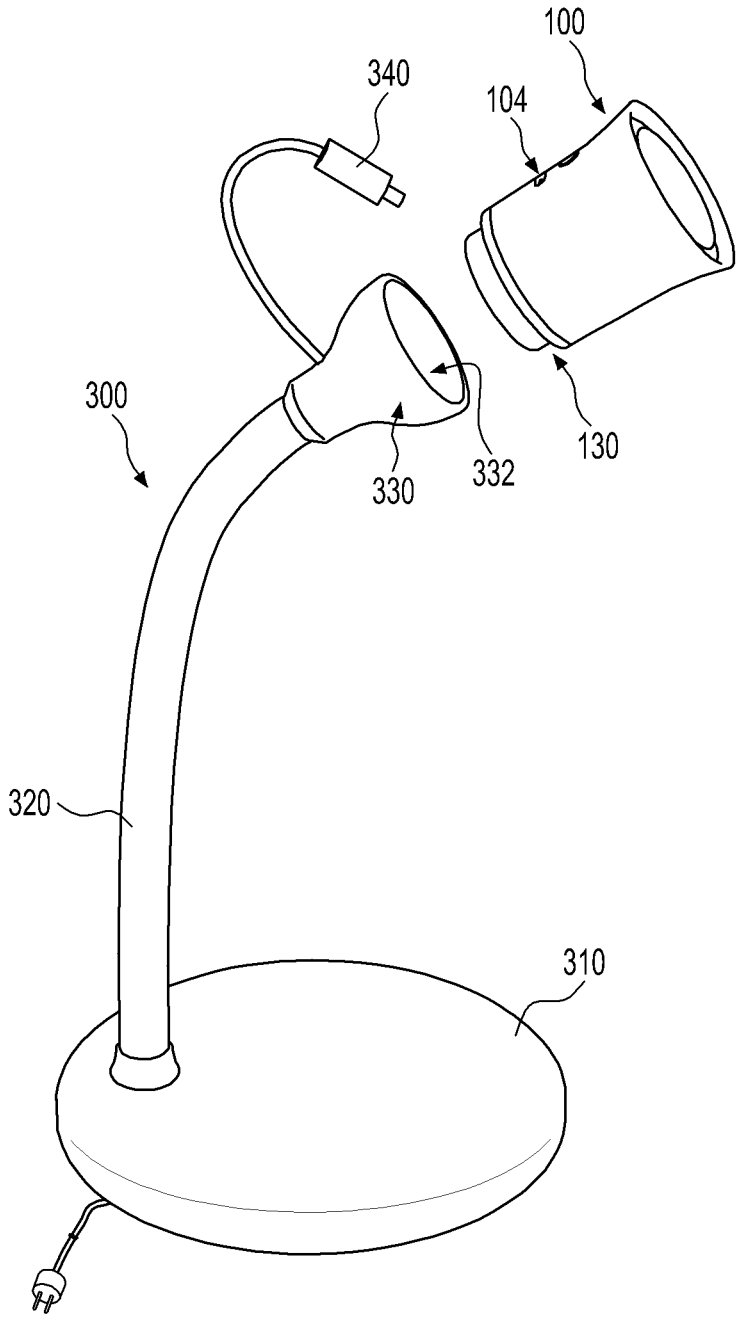
FIGS. 10 and 11 are views showing a structure of a cradle, on which the portable speaker device according to the present invention is mounted, and a mounted state.
Figure 11:
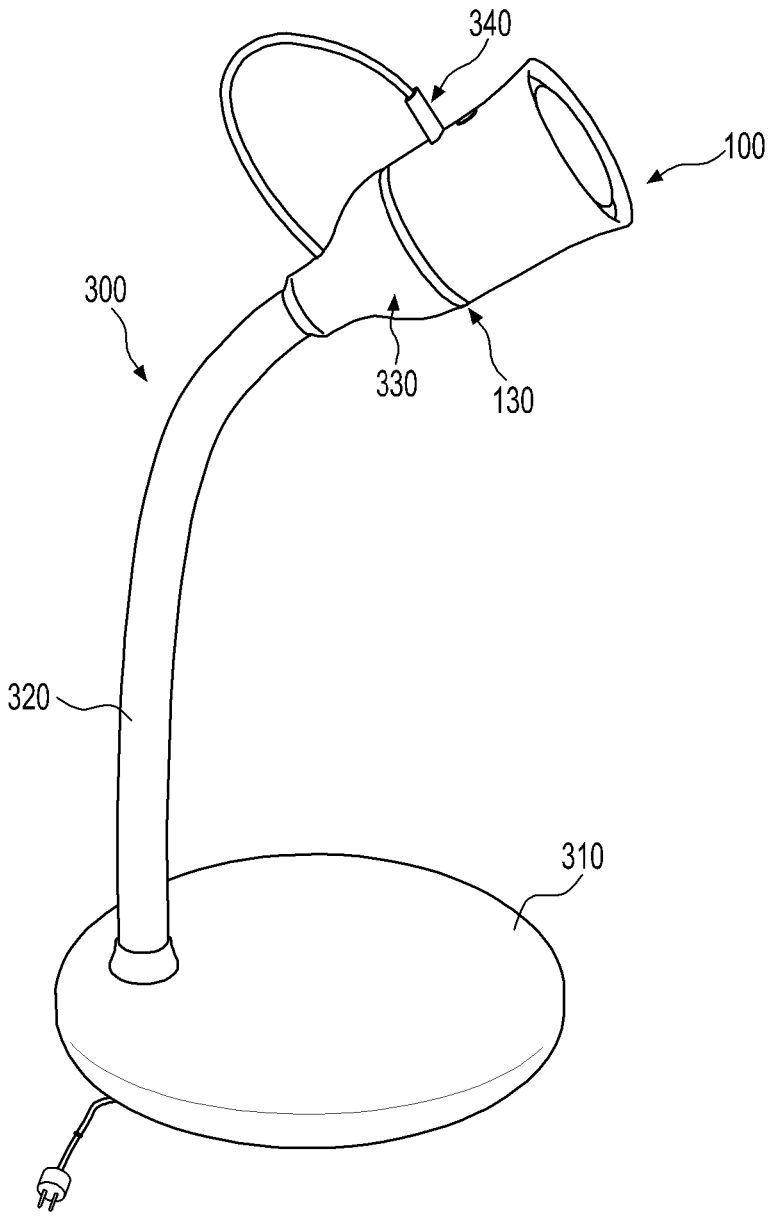

FIGS. 10 and 11 are views showing a structure of a cradle, on which the portable speaker apparatus according to the present invention is mounted, and a mounted state.

Referring to FIGS. 10 and 11, the portable speaker device 100 according to the present invention can be carried so that the user can enjoy music at various outdoor places during outdoor activities. In addition, the portable speaker device 100 according to the present invention can also be usually used indoors. To this end, the portable speaker device 100 further includes a cradle 300 for enjoying music and/or charging the battery 124.

The cradle 300 includes: a support 310 put at an indoor installation place; a pillar 320 having a lower end fixed to the support 310; a holder 330 which is provided at an upper end of the pillar 320 and into which the first mounting member 130 of the portable speaker device 100 is inserted so as to hold the portable speaker device 100; and a charging plug connector 340 (i.e., a charging jack) provided on one side of the holder 33 and inserted into the socket connector 104 of the portable speaker device 100 so as to charge the battery 124 of the portable speaker device 100.

The support 310 includes a power plug on one side thereof, and a power adaptor (not shown) which receive AC power through the power plug, converts the AC power into DC power, and supplies the DC power to the charging jack 340.

The entire pillar 320 or a partial upper end of the pillar 320 is provided with a flexible pipe so as to adjust a holding direction of the held portable speaker device 100. As another example, an angle adjustment part (not shown) for adjusting the holding direction stepwise may be provided at a specific position between the pillar 320 and the holder 330.

The holder 330 is provided in a shape similar to, for example, an inverted cone (or a funnel). An upper portion of the holder 330 is opened to form the insertion port into which the first mounting member 130 of the portable speaker device 100 is inserted.

The charging jack 340 is provided in, for example, a micro USB type and is electrically connected to the power plug through the cable installed inside the support 310, the pillar 320, and the holder 330. The charging jack 340 is inserted into the connector 104 of the portable speaker device 100, and the battery 124 is charged through the charging jack 340.

Therefore, when the portable speaker device 100 is not usually used indoors, the cradle 300 may hold and keep the portable speaker device 100, or may hold the portable speaker device 100 to enjoy music or charge the battery 124.

Figure 12:
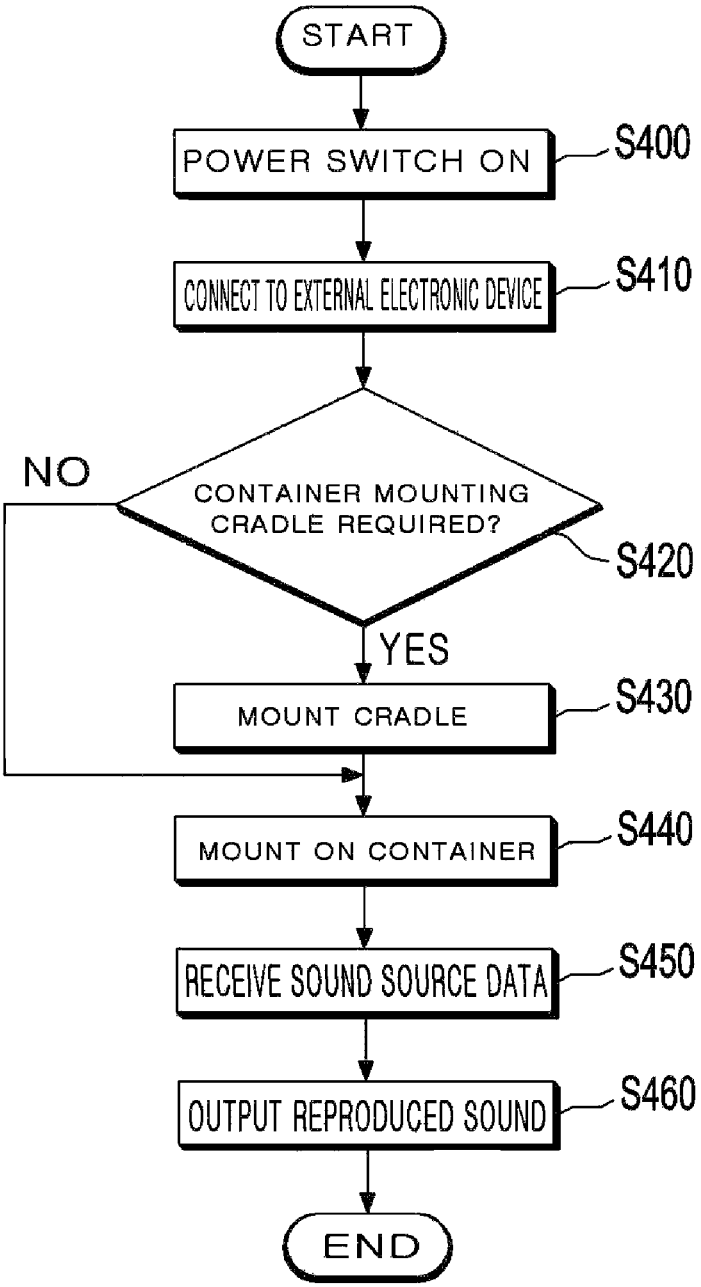
FIG. 12 is a flowchart of a method for using a portable speaker device according to the present invention.

FIG. 12 is a flowchart of a method for using a portable speaker device according to the present invention.

Referring to FIG. 12, in step S400, power is supplied to the portable speaker device 100 by pressing the power switch 102. In step S410, the portable speaker device 100 is recognized through wireless communication by the mobile device 20, for example, smartphone, and the smartphone and the portable speaker device 100 are connected to each other.

In step S420, it is determined whether the openings 202 of the containers 200 to 230 on which the portable speaker device 100 is mounted has a diameter mountable on the first mounting member 130.

That is, it is determined whether the second mounting member, that is, the cradle, is required according to whether the containers 200 to 230 are mountable on the first mounting member or the second mounting member 140.

When it is determined that the container 200 is mountable on the first mounting member 130, the cradle is not required, and thus, the process proceeds to step S440. When the containers 210 to 230 are mountable on the second mounting member 140, the cradle is required, and thus, the process proceeds to step S430 to mount the second mounting member 140 on the first mounting member 130.

In step S440, the portable speaker device 100 is mounted on the container 200 or 210 to 230 through the first or second mounting member 130 or 140. In step S450, when the sound source data is reproduced in the smartphone, the reproduced sound source data is received from the smartphone through wireless communication. In step S460, the reproduced sound of the sound source data is output.

As described above, the portable speaker device 100 includes at least one speaker 106 and 108 and is mounted on the containers 200 to 230 having various types, materials, shapes, and sizes to output the reproduced sound of the sound source data, so that the user can enjoy music in a new way and feeling.

The configuration and operation of the portable speaker device according to the present invention has been described in detail and shown in the drawings, this is merely an example. Various modifications and changes can be made thereto within departing from the scope of the present invention.

While the present invention has been particularly shown and described with reference to exemplary embodiments thereof, it will be understood by those of ordinary skill in the art that various changes in form and details may be made therein without departing from the spirit and scope of the present invention as defined by the following claims.

The invention claimed is:

1. A portable speaker device, which is usable with a container having an opening in a portion thereof, the portable speaker device comprising:

a first speaker and a second speaker;

a signal processor configured to receive sound source data reproduced from an external electronic device by using wired or wireless communication and perform signal processing thereon to output the reproduced sound of the sound source data through the speakers;

a housing provided in a pillar shape in which upper portion and lower portion thereof are opened, wherein the speaker is installed in at least one of the upper portion and the lower portion of the housing, and the signal processor is installed inside the housing; and a first mounting member coupled to a lower end of the housing and mounted in the opening so that the reproduced sound of the sound source data output from the speaker is transmitted to the container, wherein the housing comprises:

a first rubber damper coupled to an upper portion of the first speaker to cover a front surface of the first speaker;

a protection cover disposed above the first rubber damper and coupled to an inner upper end of the housing to protect the first speaker;

a fixing member inserted into the housing and fixedly coupled to the housing to fix a printed circuit board, on which a power switch, a battery, and a charging socket connector are mounted, and fix the first and second speakers and the signal processor;

a second rubber damper coupled to a lower portion of the second speaker to cover a front surface of the second speaker; and a coupling groove which is formed in an inner lower end and to which an upper portion of the first mounting member is fixedly coupled.

2. The portable speaker device of claim 1, further comprising a second mounting member coupled to a lower end of the first mounting member, so that the container having the opening with a different diameter is inserted and mounted into a lower portion of the second mounting member.

3. The portable speaker device of claim 2, wherein the first speaker is disposed in an upper portion of the housing to output a treble of the reproduced sound in an upward direction of the housing; and the second speaker is disposed in a lower portion of the housing to output a bass of the reproduced sound in a downward direction of the housing.

4. The portable speaker device of claim 3, wherein the signal processor comprises:

a wireless communication unit configured to enable wireless communication with the external electronic device;

a sound source processing unit configured to output the reproduced sound of the sound source data received from the wireless communication unit to the first and second speakers; and a controller configured to control the wireless communication unit and the sound source processing unit.

5. The portable speaker device of claim 1, wherein the first mounting member comprises:

a container coupling part coupled to the opening in an outer or inner space of a lower end;

a housing coupling part coupled to the coupling groove of the housing; and a flat plate part provided inside the housing coupling part and stacked in a lower portion of the second rubber damper to cover a lower surface of the housing.

6. The portable speaker device of claim 5, wherein the second mounting member comprises:

a container coupling part insertion port which has a cylindrical shape of a double structure where an upper portion is separated and a lower portion is mutually coupled, and into which the container coupling part of the first mounting member is inserted; and a container insertion port which is provided inside the container coupling part insertion port and into which the opening of the container is inserted.

7. The portable speaker device of claim 6, further comprising a cradle installed indoors and held to output the reproduced sound of the sound source data, or held to charge a battery for supplying power to the portable speaker device.

8. The portable speaker device of claim 1, wherein the first speaker is disposed in an upper portion of the housing to output a treble of the reproduced sound in an upward direction of the housing; and the second speaker is disposed in a lower portion of the housing to output a bass of the reproduced sound in a downward direction of the housing.

9. The portable speaker device of claim 8, wherein the signal processor comprises:

a wireless communication unit configured to enable wireless communication with the external electronic device;

a sound source processing unit configured to output the reproduced sound of the sound source data received from the wireless communication unit to the first and second speakers; and a controller configured to control the wireless communication unit and the sound source processing unit.

10. The portable speaker device of claim 9, wherein the first mounting member comprises:

a container coupling part coupled to the opening in an outer or inner space of a lower end;

a housing coupling part coupled to the coupling groove of the housing; and a flat plate part provided inside the housing coupling part and stacked in a lower portion of the second rubber damper to cover a lower surface of the housing.

* * * * *